US011165198B2

(12) United States Patent
Masuda et al.

(10) Patent No.: US 11,165,198 B2
(45) Date of Patent: Nov. 2, 2021

(54) CONNECTOR

(71) Applicant: Sumitomo Wiring Systems, Ltd., Mie (JP)

(72) Inventors: Shinpei Masuda, Mie (JP); Masahiro Matoba, Mie (JP)

(73) Assignee: Sumitomo Wiring Systems, Ltd.

( * ) Notice: Subject to any disclaimer, the term of this patent is extended or adjusted under 35 U.S.C. 154(b) by 110 days.

(21) Appl. No.: 16/806,576

(22) Filed: Mar. 2, 2020

(65) Prior Publication Data

US 2020/0287326 A1 Sep. 10, 2020

(30) Foreign Application Priority Data

Mar. 4, 2019 (JP) ..... JP2019-038411

(51) Int. Cl.

| | |
|---|---|
| ***H01R 13/627*** | (2006.01) |
| ***H01R 13/42*** | (2006.01) |
| ***H01R 13/641*** | (2006.01) |
| ***H01R 13/502*** | (2006.01) |
| ***H01R 13/639*** | (2006.01) |

(52) U.S. Cl.

CPC ..... *H01R 13/6272* (2013.01); *H01R 13/42* (2013.01); *H01R 13/502* (2013.01); *H01R 13/6275* (2013.01); *H01R 13/639* (2013.01); *H01R 13/641* (2013.01)

(58) Field of Classification Search

CPC .. H01R 13/6275; H01R 13/502; H01R 13/42; H01R 13/6272; H01R 13/641; H01R 13/639

See application file for complete search history.

(56) References Cited

U.S. PATENT DOCUMENTS

| | | | | |
|---|---|---|---|---|
| 7,399,195 | B2 * | 7/2008 | Kim | H01R 13/641 439/352 |
| 7,909,638 | B2 * | 3/2011 | Seo | H01R 13/6272 439/489 |
| 9,022,797 | B2 * | 5/2015 | Kon | H01R 13/641 439/352 |
| 2013/0237083 | A1 | 9/2013 | Kon et al. | |
| 2014/0134867 | A1 | 5/2014 | Kon et al. | |
| 2017/0207575 | A1 | 7/2017 | Jabrane et al. | |
| 2017/0207594 | A1 | 7/2017 | Jabrane et al. | |

FOREIGN PATENT DOCUMENTS

| | | |
|---|---|---|
| JP | 2013-187116 | 9/2013 |

* cited by examiner

*Primary Examiner* — Edwin A. Leon
*Assistant Examiner* — Paul D Baillargeon
(74) *Attorney, Agent, or Firm* — Gerald E. Hespos; Michael J. Porco; Matthew T. Hespos

(57) ABSTRACT

A lock arm is formed with a first receiving surface and two second receiving surfaces, and the second receiving surfaces are disposed to sandwich the first receiving surface from both sides in a width direction intersecting a resilient displacing direction of the lock arm. A resilient arm of a detector includes a first butting portion configured to butt against the first receiving surface, a separation restricting portion projecting farther forward than the first butting portion from a position closer to a housing body than the first butting portion, and two second butting portions projecting from both widthwise outer side surfaces of the resilient arm. The second butting portions restrict a movement of the detecting member at an initial position to a detection position by butting against the second receiving surfaces.

11 Claims, 18 Drawing Sheets

CONNECTOR

BACKGROUND

Field of the Invention

The disclosure relates to a connector.

Related Art

Japanese Unexamined Patent Publication No. 2013-187116 discloses a connector including a housing having a lock arm and a detector mounted on the housing. The lock arm faces an outer surface of a housing body and includes a lock projection. A locking surface is formed on the rear of the lock projection, and a recess is formed in an inner surface of the lock projection to face the outer surface of the housing body. The detector is movable between an initial position and a detection position forward of the initial position. A resilient arm extends forward on the detector. A protrusion is formed on a front part of the resilient arm and projects toward a side opposite to the housing body, and a movement restricting surface is formed on the front surface of the protrusion. A contact is formed on the front part of the resilient arm and projects farther forward than the movement restricting surface. The contact is adjacent to a position closer to the housing body than the movement restricting surface.

With the housing incompletely connected to a mating housing, the lock arm interferes with a lock receiving portion of the mating housing to be displaced resiliently toward the housing body. The recess presses the contact and displaces the resilient arm resiliently toward the housing body. Thus, a front stop state is set with a forward movement to the detection position restricted by the butting of the movement restricting surface against the locking surface.

The lock projection passes through the lock receiving portion when the housing and the mating housing reach a properly connected state. Thus, the lock arm resiliently returns. On the other hand, the resilient arm is kept resiliently displaced toward the housing body due to interference with the lock receiving portion, and the butting of the movement restricting surface and the locking surface is released. In this way, the detector is released from the front stop state, and the detector can be moved to the detection position.

Areas of the movement restricting surface and the locking surface may be increased to enhance a holding force necessary to hold the detector at the initial position. The area of the movement restricting surface could be enlarged in a resilient displacing direction of the resilient arm. However, the contact is arranged adjacently on a side closer to the housing body than the movement restricting surface. This positioning prevents the movement restricting surface from being enlarged toward the housing body. Further, with the detector moved to the detection position, the protrusion enters the recess and is sandwiched between the lock projection and the housing body. Thus, if the movement restricting surface is enlarged toward a side opposite to the housing body, an interval between the housing body and the lock arm has to be widened in the resilient displacing direction of the lock arm and the connector is enlarged.

A connector of this disclosure was completed on the basis of the above situation and aims to improve the reliability of a function of holding a detector at an initial position without enlargement.

SUMMARY

The disclosure is directed to a connector with a connector housing and a lock arm extending rearward along an outer surface of a housing body of the connector housing. The lock arm is resiliently displaceable toward and away from the outer surface of the housing body. A detector is mounted along the outer surface of the housing body and is displaceable between an initial position and a detection position forward of the initial position. A lock projection is formed on an outer surface of the lock arm and can be hooked to a lock receiving portion of a mating housing. A rearwardly facing first receiving surface and two rearwardly facing second receiving surfaces facing are formed at positions of the lock arm closer to the housing body than the lock projection. The second receiving surfaces are disposed at two positions sandwiching the first receiving surface from both sides in a width direction intersecting a resilient displacing direction of the lock arm in a back view. The detector is formed with a resilient arm cantilevered forward and displaceable toward and away from the outer surface of the housing body. The resilient arm includes a first butting portion for restricting a movement of the detector at the initial position to the detection position by butting against the first receiving surface. The resilient arm also includes a separation restricting portion projecting farther forward than the first butting portion from a position closer to the housing body than the first butting portion. The separation restricting portion is capable of contacting the lock arm from the side of the housing body. The resilient arm includes two second butting portions projecting from both widthwise outer side surfaces of the resilient arm. The second butting portions restrict the movement of the detector at the initial position to the detection position by butting against the second receiving surfaces.

The connector of this disclosure secures a wide contact area by butting the second butting portions against the second receiving surfaces in addition to butting the first butting portion against the first receiving surface as a front stop for holding the detector at the initial position in a front stop state. Thus, a holding force at the front stop is high. The first and second butting portions are arranged side by side in the width direction intersecting the resilient displacing directions of the lock arm and the resilient arm. The second butting portions are not arranged in such a positional relationship as to be side by side with the first butting portion and the separation restricting portion in the resilient displacing direction of the lock arm. Thus, a dimension of the resilient arm is small, and an interval between the housing body and the lock arm need not be large in the resilient displacing direction of the lock arm. Accordingly, the detecting member is held reliably at the initial position without enlarging the connector.

The second butting portions may be at least partially in regions deviated from a formation region of the first butting portion in the resilient displacing direction of the lock arm. According to this configuration, a range where the lock arm and the resilient arm butt against each other is expanded in the resilient displacing direction of the lock arm so that relative postures of the lock arm and the resilient arm portion are stabilized.

Formation regions of the second butting portions on a surface of the resilient arm facing the housing body may be flush with or relatively recessed with respect to regions other than the second butting portions. Since only the formation regions of the second butting portions are not projecting on the surface of the resilient arm facing the housing body, the entire resilient arm can be brought maximally close to the outer surface of the housing body when the lock arm and the resilient arm are displaced resiliently. Therefore, the connector is not enlarged in the resilient displacing direction of the lock arm.

The lock arm may include a base connected to the housing body and two extending portions extending rearward from a rear end of the base while being space apart in the width direction. The two second receiving surfaces are disposed between the two extending portions in a back view. A state where the two second butting portions butt against the two second receiving surfaces can be confirmed visually through a clearance between the extending portions.

The lock arm may include a base connected to the housing body and two extending portions extending rearward from a rear end of the base while being space apart in the width direction. The first receiving surface is disposed between the extending portions in a back view, and two recesses capable of accommodating the two second butting portions are formed in surfaces of the extending portions facing the housing body. The extending portions of this configuration include parts for covering the second butting portions from a side opposite to the housing body. Thus, a large width can be secured for the extending portions, including the recesses, as compared to the case where there is no part for covering the second butting portions. Therefore, strength is high.

The two second butting portions may be configured to contact the two recesses from the side of the housing body when the detecting member is at the initial position. The contact of the second butting portions with the recesses restricts a positional deviation and an inclination of the resilient arm with respect to the lock arm. In this way, a butting state of the first butting portion and the first receiving surface and that of the second butting portions and the second receiving surfaces can be held reliably.

A reinforcing portion adjacent to front parts of inner edges of the extending portions may be formed on a surface of the base opposite to the housing body. The inner edges of the extending portions where the recesses are formed are thinned, and there is a concern about reduced strength. However, the reinforcing portion is connected to the front parts of the inner edges of the extending portions, so that the inner edges of the extending portions are strong.

The reinforcing portion functions as the lock projection. Since the reinforcing portion doubles as the lock projection, the shape of the lock arm can be simplified.

According to the present disclosure, it is possible to improve the reliability of a function of holding a detector at an initial position without enlarging a connector.

DETAILED DESCRIPTION

First Embodiment

A first embodiment of a female connector Fa (connector as claimed) of the present disclosure is described with reference to FIGS. 1 to 9. In the first embodiment, a left side in FIGS. 1, 2, 4, 5 and 7 to 9 is defined as a front concerning a front-rear direction. Upper and lower sides shown in FIGS. 1 and 3 to 9 are defined as upper and lower sides concerning a vertical direction. Left and right sides shown in FIG. 3 are directly defined as left and right sides concerning a lateral direction. The lateral direction and a width direction are synonymous. A resilient displacing direction of a lock arm 13, a resilient displacing direction of a resilient arm portion 26 and the vertical direction are synonymous.

Figure 1:
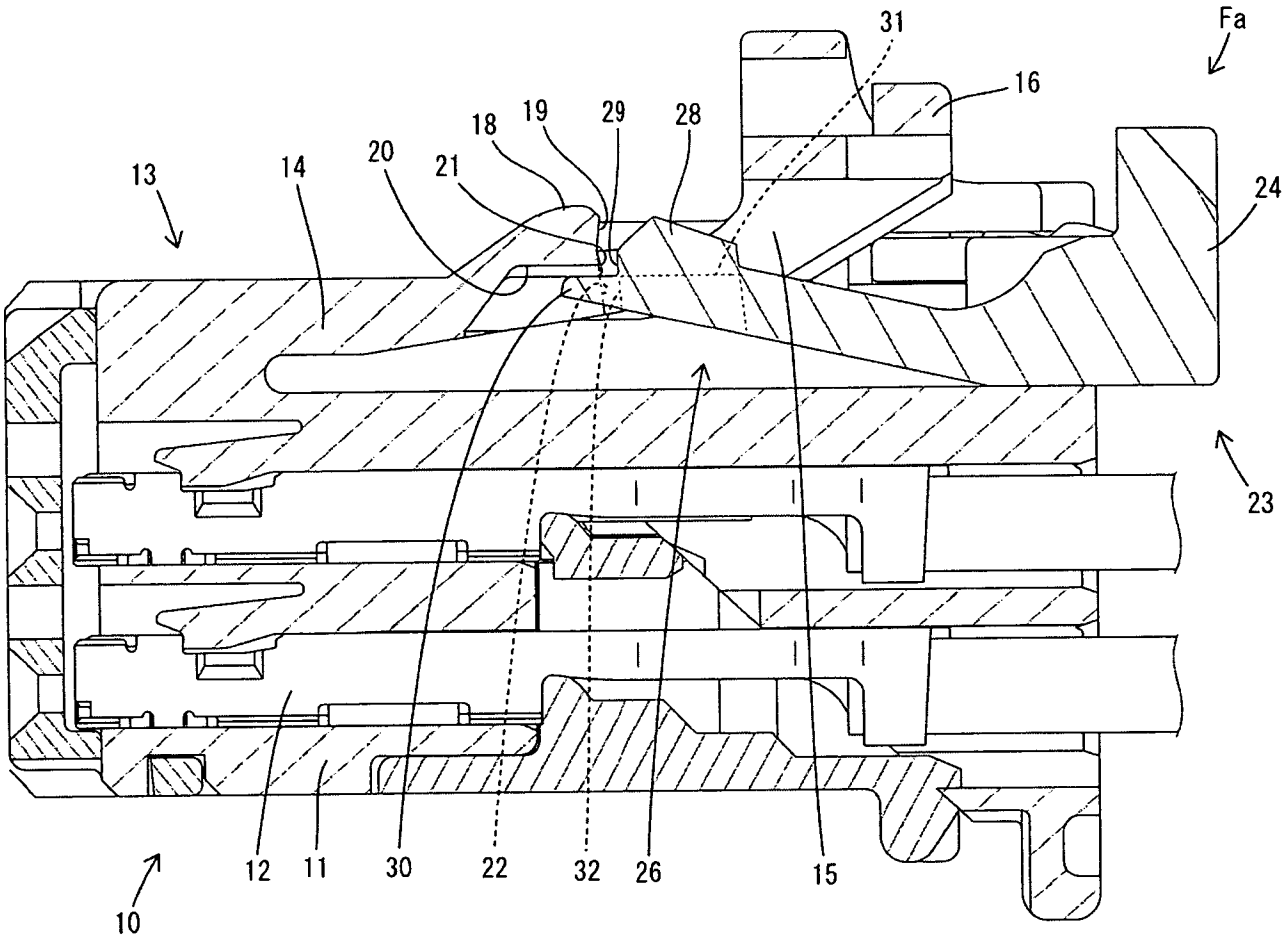
FIG. 1 is a side view in section showing a state where a detecting member is held at an initial position in a female connector (connector) of a first embodiment.

As shown in FIG. 1, the female connector Fa includes a female housing 10 (connector housing as claimed), a detecting member 23 and female terminal fittings 12. The female housing 10 has a housing body 11 made of synthetic resin and a lock arm 13 integral with the housing body 11. The female terminal fittings 12 are accommodated in the housing body 11.

Figure 2:
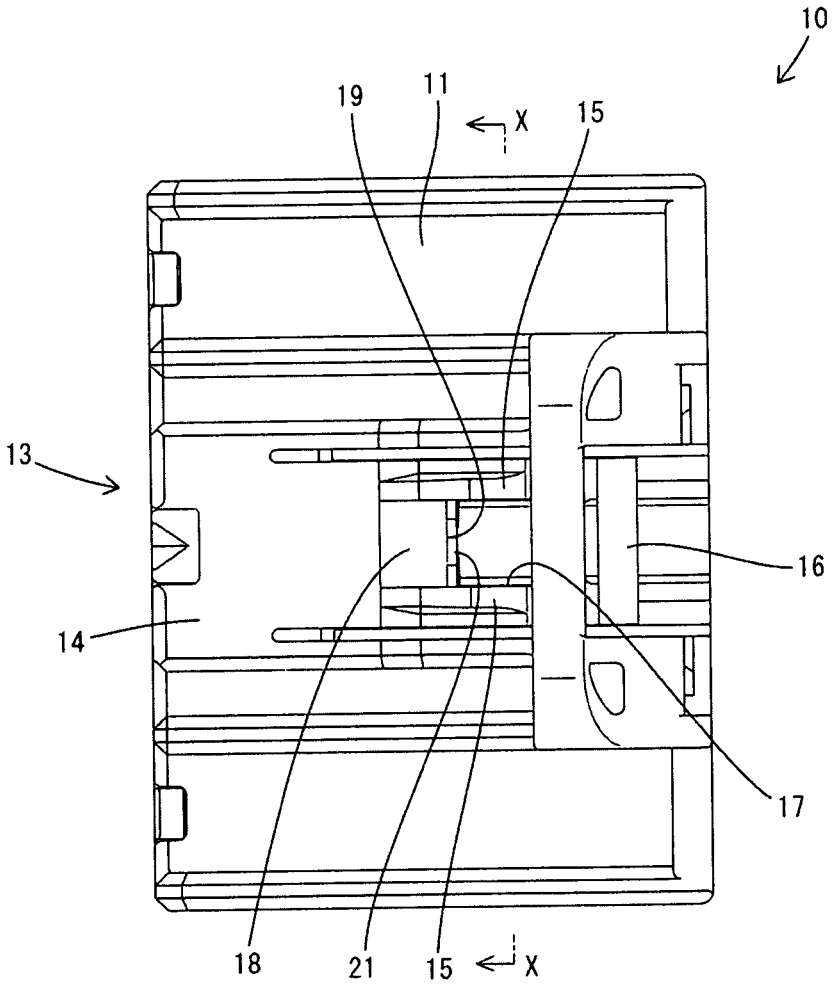
FIG. 2 is a plan view of a female housing (connector housing).
Figure 3:
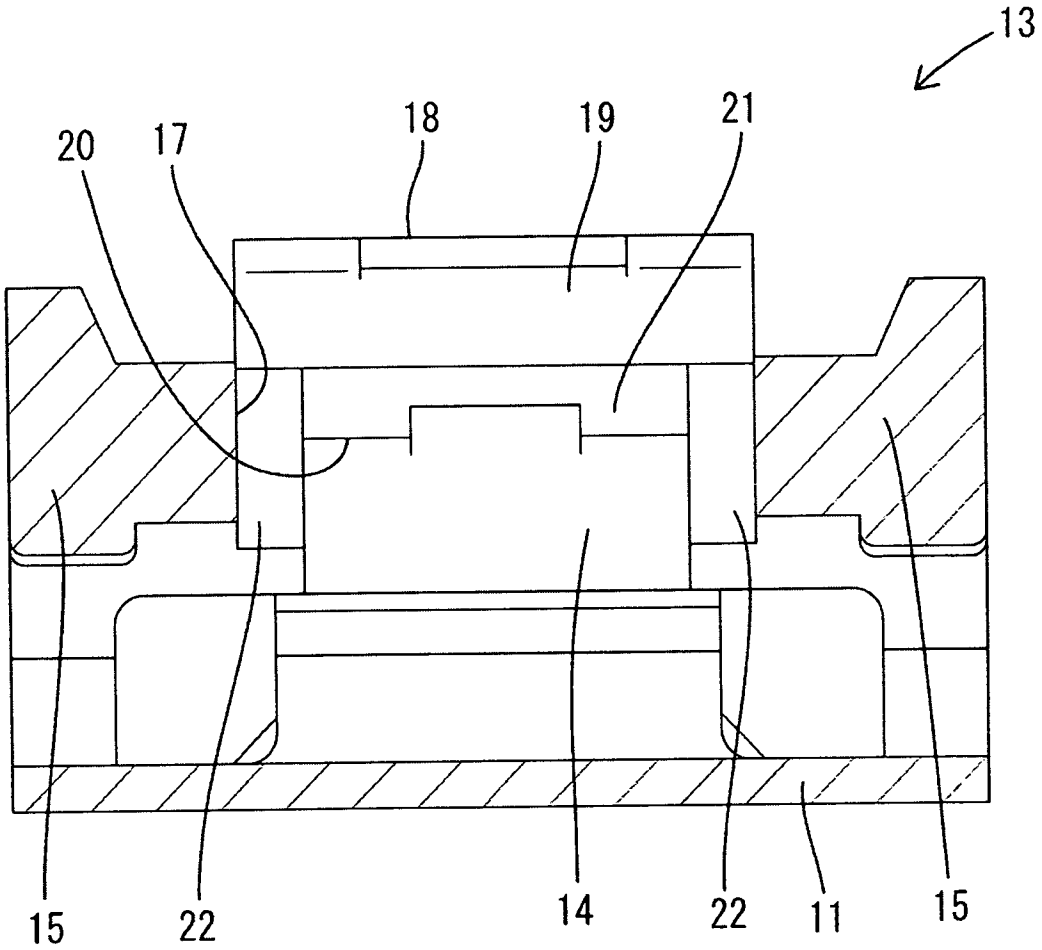
FIG. 3 is a section along X-X of FIG. 2.

As shown in FIGS. 1 and 2, the lock arm 13 includes a base 14, left and right extending portions 15 spaced apart in the width direction, and an operating portion 16. The base 14 is a flat plate extending rearward in parallel to an outer surface (upper surface) of the housing body 11 from a front part of the outer surface of the housing body 11. The extending portions 15 extend rearward along the outer surface of the housing body 11 from both widthwise ends of the rear end edge of the base 14. Rear parts (extending end parts) of the extending portions 15 are coupled by the operating portion 16.

Figure 4:
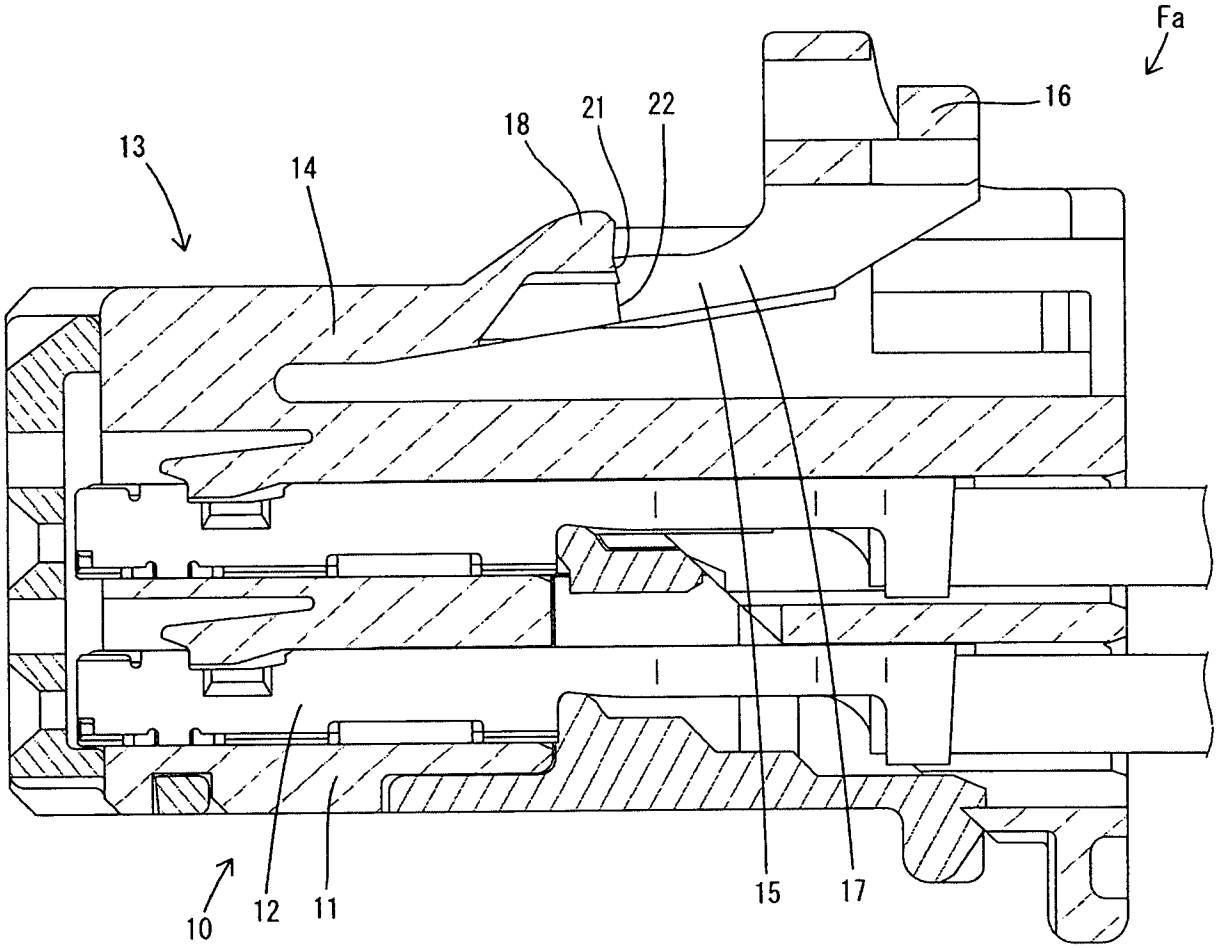
FIG. 4 is a side view in section of the female housing (connector housing).

As shown in FIGS. 2 to 4, a space of the lock arm 13 surrounded by a rear part of the base 14, the extending portions 15 and the operating portion 16 forms an opening 17 penetrating through the lock arm 13 in the vertical direction. A lock projection 18 projects up on a rear part of an outer surface (surface opposite to the housing body 11) of the base 14. A formation region of the lock projection 18 in the width direction is the same range as an opening region of the opening 17. A lock surface 19 is on the rear of the lock projection 18. The lock arm 13 is resiliently displaceable in the vertical direction toward and away from the outer surface of the housing body 11 with a front part of the base 14 as a fulcrum.

As shown in FIGS. 1 and 3 to 5, an accommodating portion 20 is recessed in a rear part of the base 14 facing the housing body 11 and below the lock projection 18. A formation region of the accommodating portion 20 in the width direction is a range inside (center side) the formation region (inner side surfaces of the extending portions 15) of the lock projection 18.

Figure 5:
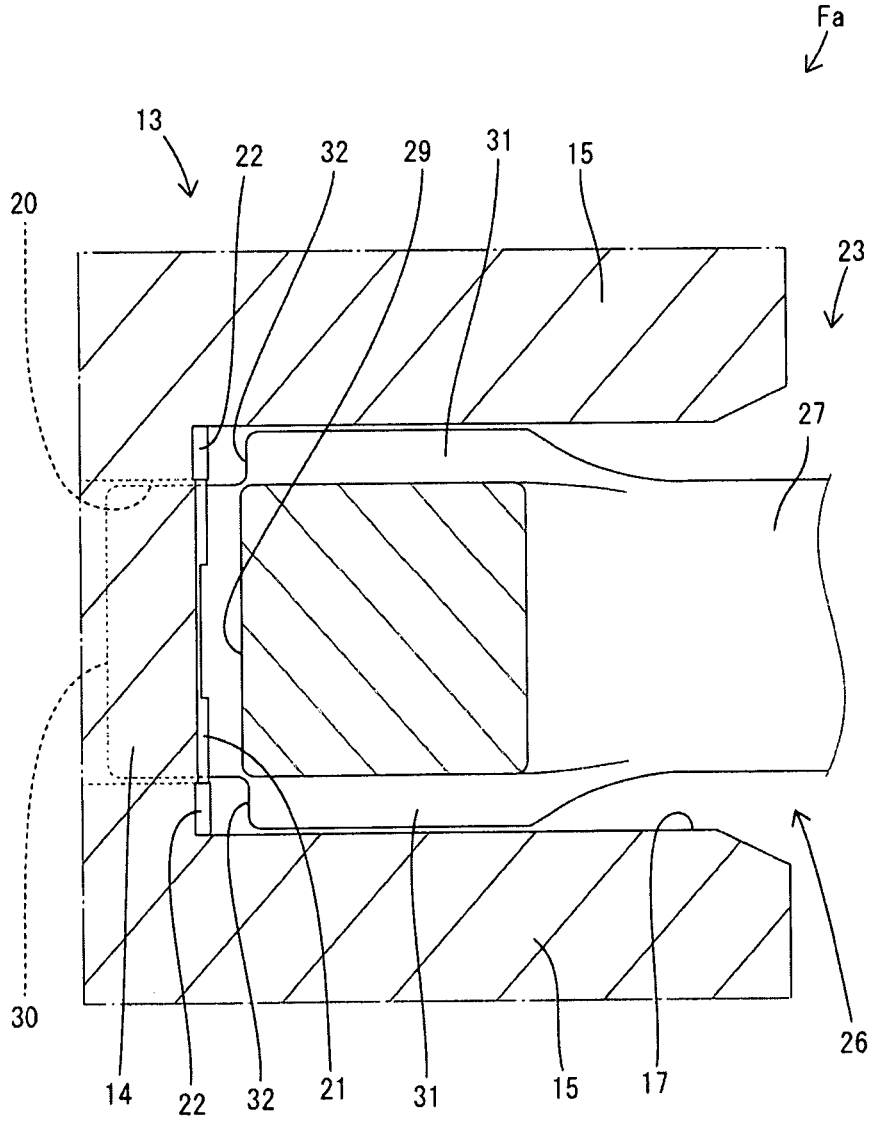
FIG. 5 is a plan view in section showing the state where the detecting member is held at the initial position.

As shown in FIG. 1, a wide first receiving surface 21 is formed on the rear end part of the base 14. The first receiving surface 21 is located below and adjacent to the lock surface 19. The lock surface 19 and the first receiving surface 21 are disposed at the same position in the front-rear direction. The first receiving surface 21 is disposed within the range of formation regions of the extending portions 15 in the vertical direction. As shown in FIGS. 3 and 5, a formation region of the first receiving surface 21 in the width direction is the same range as the accommodating portion 20. The first receiving surface 21 faces the inside of the opening 17.

As shown in FIGS. 3 and 5, two second receiving surfaces 22 are formed on the rear surface of the base 14 and are disposed to sandwich the first receiving surface 21 from both widthwise sides in a back view and a plan view. As shown in FIG. 3, the second receiving surfaces 22 are elongated in the vertical direction and adjacent to both widthwise end edges of the first receiving surface 21.

A formation region of the second receiving surfaces 22 in the vertical direction is a range from the same height position as the upper end edge of the first receiving surface 21 to a position lower than the lower end edge of the first receiving surface 21. The second receiving surfaces 22 are disposed within the range of the formation regions of the extending portions 15 in the vertical direction. As shown in FIGS. 4 and 5, the second receiving surfaces 22 face the inside of the opening 17. Outer side edges of the second receiving surfaces 22 in the width direction are connected at a right angle to the inner side surfaces of the extending portions 15. The first receiving surface 21 and the second receiving surfaces 22 are at the same position in the front-rear direction.

Figure 6:
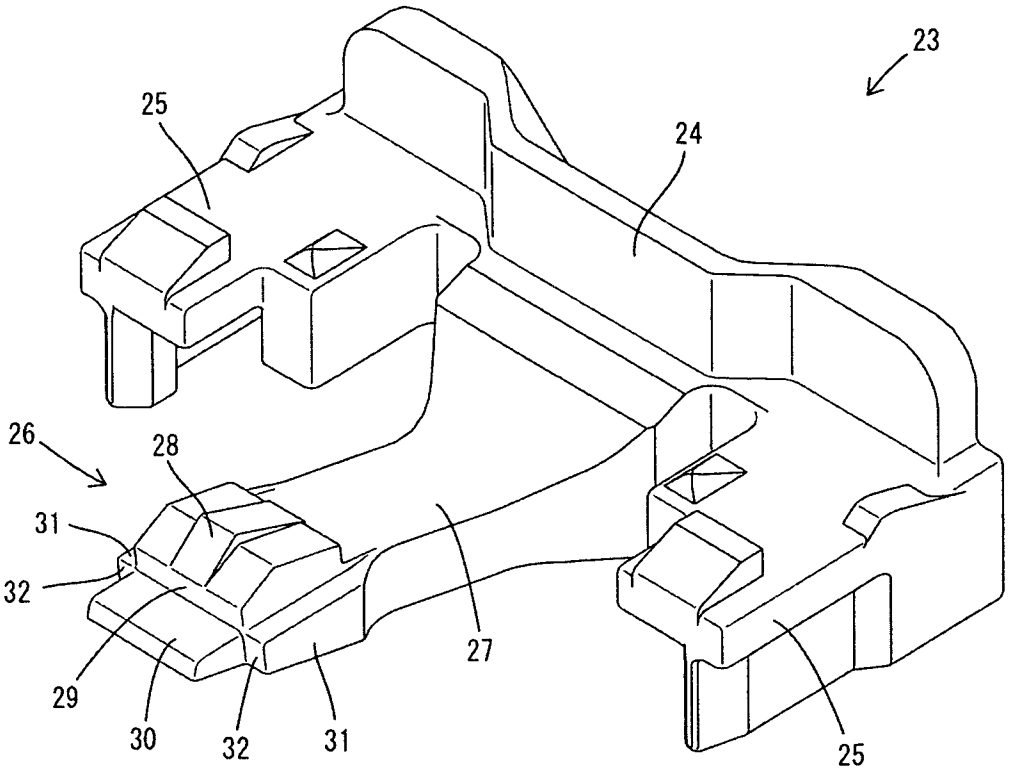
FIG. 6 is a perspective of the detecting member of the first embodiment.

The detector 23 is a single component made of synthetic resin and includes a rear wall 24, left and right guided portions 25 and the resilient arm 26, as shown in FIG. 6. The guided portions 25 are cantilevered forward from both widthwise ends of the rear wall 24. The resilient arm 26 is cantilevered forward from a widthwise center part of the rear wall 24. The detector 23 is mounted on the connector housing to extend along the outer surface of the housing body 11.

With the detector 23 mounted on the connector housing, the guided portions 25 are fit in guide grooves (not shown) of the housing body 11 and, as shown in FIG. 1, the rear wall 24 and the guided portions 25 are disposed to overlap on the outer surface of the housing body 11. The mounted detector 23 is displaceable in the front-rear direction between an initial position (see FIGS. 1, 5, 7 and 8) and a detection position (see FIG. 9) forward of the initial position with respect to the housing body 11.

The resilient arm 26 is displaceable toward and away from the outer surface of the housing body 11, similar to the lock arm 13. As shown in FIG. 1, the resilient arm 26 that is not in a resiliently displaced state extends obliquely to an upper-front side from the rear wall 24. Thus, the lower surface of the resilient arm 26 is facing at a distance from the outer surface of the housing body 11.

As shown in FIG. 6, the resilient arm 26 includes an arm body 27 extending from the rear wall 24, a first butting portion 28, a separation restricting portion 30 and left and right second butting portions 31. The first butting portion 28 projects up and away from the housing body 11 from a front end of the arm body 27. A lower part of the first butting portion 28 serves as a first butting surface 29 facing forward. The first butting surface 29 is elongated in the width direction and can butt against the first receiving surface 21 from behind. A dimension of the first butting portion 28 in the width direction is substantially equal to a facing interval between the extending portions 15 (opening width of the opening 17).

The separation restricting portion 30 projects farther forward than the first butting portion 28 (first butting surface 29) from the front surface of the arm body 27. The separation restricting portion 30 is located below (toward the housing body 11) the first butting portion 28 (first butting surface 29) and adjacent to the first butting surface 29. As shown in FIG. 5, a width of the separation restricting portion 30 is equal to that of the accommodating portion 20 of the lock arm 13.

As shown in FIGS. 5 and 6, the second butting portions 31 project in the lateral direction (width direction) from both widthwise outer side surfaces of the front of the arm body 27. As shown in FIG. 5, in a plan view of the resilient arm 26 viewed from above (side opposite to the housing body 11), the second butting portions 31 are disposed at two positions across the first butting portion 28 in the width direction and adjacent to the first butting portion 28. The front surfaces of the second butting portions 31 serve as second butting surfaces 32 facing forward. The second butting surfaces 32 at the same position as the first butting surface 29 in the front-rear direction.

As shown in FIG. 1, in a side view of the resilient arm 26 viewed laterally, the second butting portion 31 is disposed below (toward the housing body portion 11) the first butting portion 28 and adjacent to the lower edge of the first butting portion 28. Similarly, in the side view, the second butting portion 31 is disposed behind and adjacent to the separation restricting portion 30. The second butting portions 31 are positioned to be continuous and flush with regions of the resilient arm 26 facing the housing body 11 other than the second butting portions 31 (formation regions of the arm body 27 and the separation restricting portion 30).

With the detector 23 located at the initial position, the front part of the resilient arm 26 is inserted in the opening 17 from the side of the housing body 11 and the separation restricting portion 30 is accommodated in the accommodating portion 20, as shown in FIG. 1. The separation restricting portion 30 accommodated into the accommodating portion 20 contacts the upper surface of the accommodating portion 20 from below (side of the housing body 11) in a preloaded state, and a relative upward (side opposite to the housing body 11) displacement of the resilient arm 26 with respect to the lock arm 13 is restricted by this contact.

With the detector 23 located at the initial position, the first butting surface 29 of the first butting portion 28 is proximately facing the first receiving surface 21 from below and the second butting surfaces 32 of the two second butting portions 31 are proximately facing the second receiving surfaces 22 from behind. If a forward pressing force acts on the detector 23 at the initial position, the first butting surface 29 butts against the first receiving surface 21 and the two second butting surfaces 32 butt against the two second receiving surfaces 22. A forward movement of the detector 23 toward the detection position is restricted by the butting of these surfaces to hold the detector 23.

Figure 7:
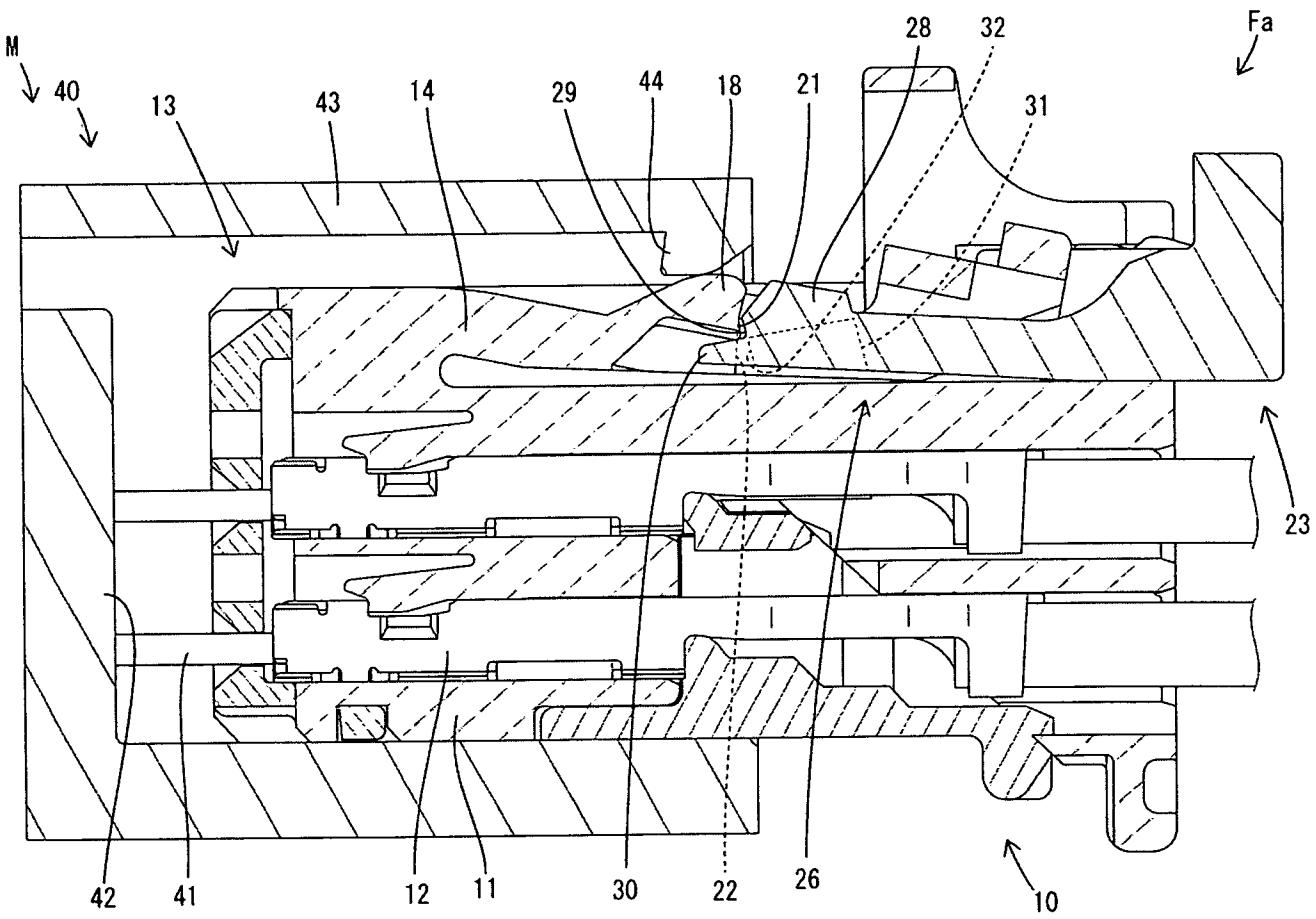
FIG. 7 is a side view in section showing a state where the female connector and a male connector are incompletely connected in a connection process.
Figure 8:
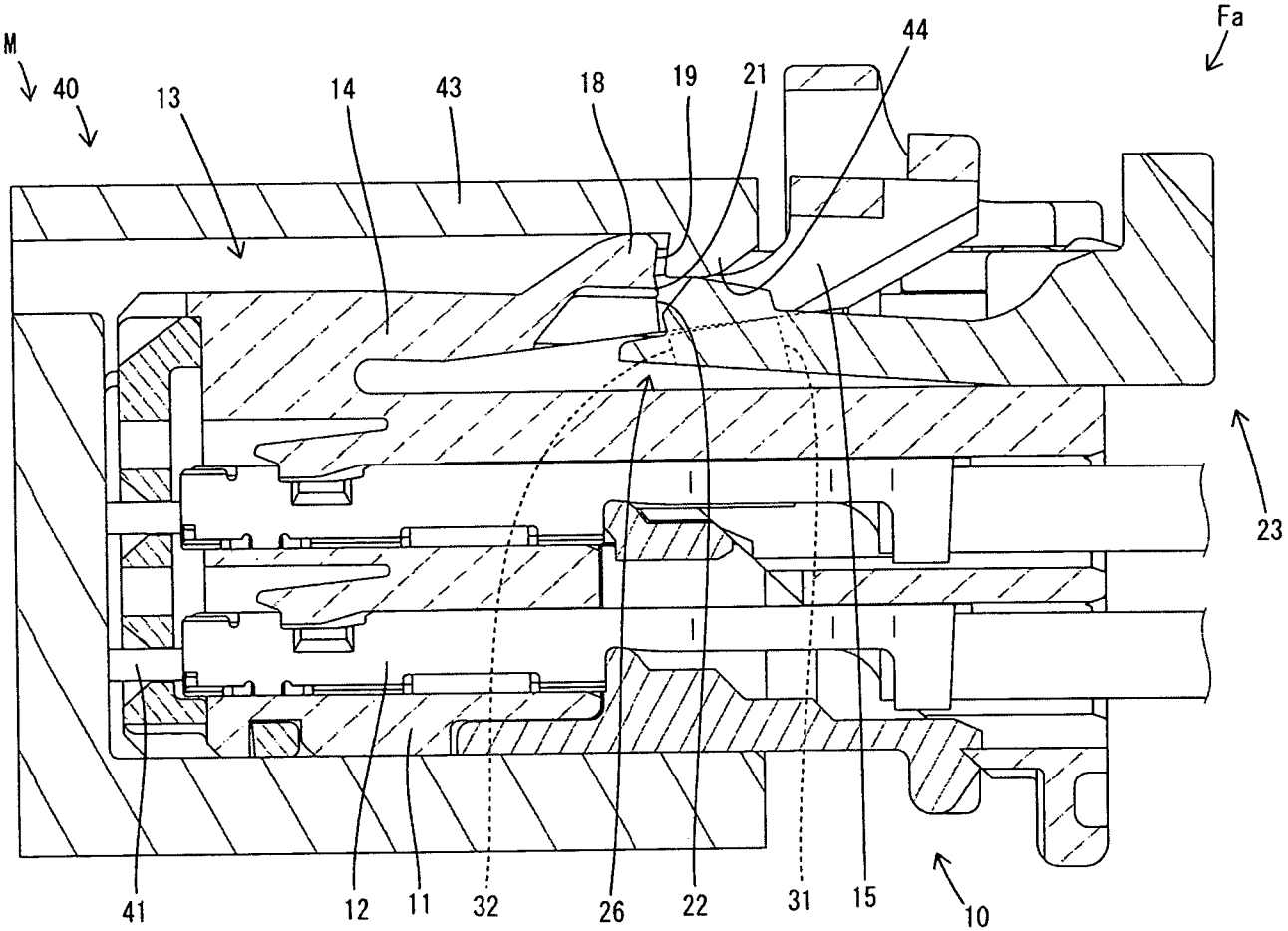
FIG. 8 is a side view in section showing a state where the female connector and the male connector are properly connected and the detecting member is at the initial position.
Figure 9:
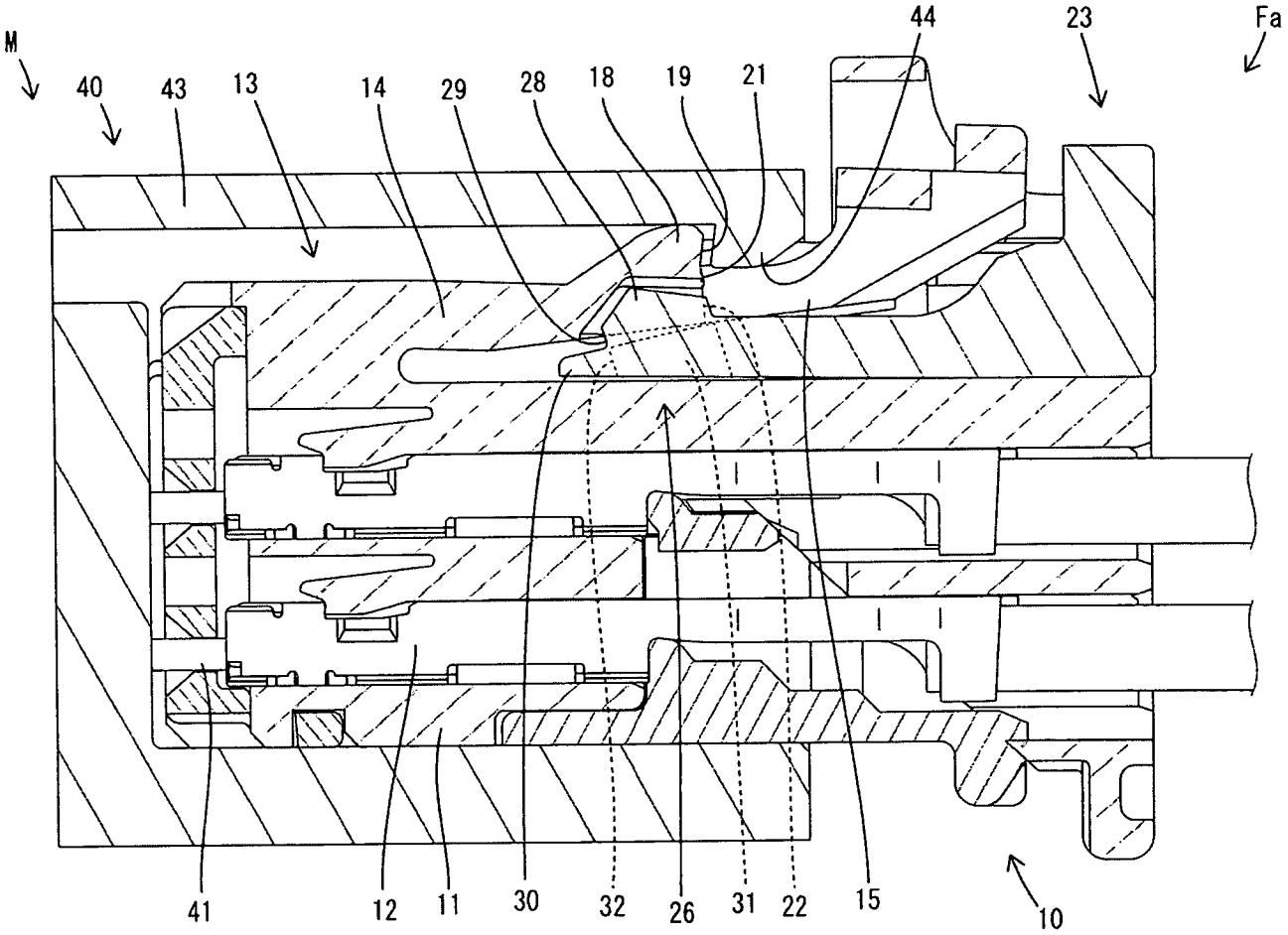
FIG. 9 is a side view in section showing a state where the female connector and the male connector are properly connected and the detecting member is at a detection position.

A male connector (mating connector) to be connected to the female connector Fa of the first embodiment includes a male housing 40 and male terminal fittings 41, as shown in FIGS. 7 to 9. The male housing 40 includes a terminal holding portion 42 and a rectangular tubular receptacle 43 projecting forward from the terminal holding portion 42. The male terminal fittings 41 are mounted in the terminal holding portion 42. A lock receiving portion 44 projects down (inwardly of the receptacle 43) from an upper wall of the receptacle 43.

Next, a connecting operation of the female connector Fa and the male connector M is described. In connecting the connectors Fa, M, the female housing 10 is inserted into the receptacle 43 with the detector 23 held at the initial position. As the connection proceeds, the lock projection 18 interferes with the lock receiving portion 44, as shown in FIG. 7, and the lock arm 13 is displaced resiliently toward the housing body 11 (unlocking direction). The rear part of the base 14 presses down the separation restricting portion 30 if the lock arm 13 is resiliently displaced. Thus, the resilient arm 26 is displaced resiliently down integrally with the lock arm 13. This state is referred to as an incompletely connected state.

In the incompletely connected state, the first butting surface 29 is kept facing the first receiving surface 21 and the two second butting surfaces 32 are kept facing the two second receiving surfaces 22. Thus, even if the detector 23 is pushed from behind in the incompletely connected state, the first butting surface 29 butts against the first receiving surface 21 and the butting surfaces 32 butt against the second receiving surfaces 22 so that the detector 23 cannot be pushed to the detection position and is kept at the initial position.

If the connecting operation of the connectors Fa, M proceeds from the incompletely connected state and the connectors Fa, M reach a properly connected state, the lock projection 18 passes through the lock receiving portion 44 and is released from a state of interference, as shown in FIG. 8. Thus, the lock arm 13 resiliently returns up to a lock position (free state). As the lock arm 13 resiliently returns, the lock surface 19 of the lock projection 18 faces the lock receiving portion 44 in the front-rear direction (direction parallel to a connecting direction of the connectors Fa, M). In this way, the connectors Fa, M are locked in a separation restricted state.

When the connectors Fa, M reach the properly connected state, the first butting portion 28 of the resilient arm 26 interferes with the lock receiving portion 44 from below (from the side of the housing body 11) and the resilient arm 26 is kept resiliently displaced toward the housing body 11. Thus, as the lock arm 13 resiliently returns to the lock position, the first receiving surface 21 is separated upward from the first butting surface 29 and the second receiving surfaces 22 also are separated upward from the second butting surfaces 32. The detector 23 becomes movable from the initial position to the detection position by the separation of these surfaces. Thus, the detector 23 moves forward and is pushed to the detection position, as shown in FIG. 9, if the rear wall 24 of the detector 23 is pushed from behind.

As just described, whether the connectors Fa, M are in the properly connected state or in the incompletely connected state can be detected based on whether or not the detector 23 can be moved to the detection position. Further, the detector 23 can be held reliably at the initial position with the connectors Fa, M separated. Further, the structure for butting the second butting surfaces 32 against the second receiving surfaces 22 is employed in addition to the structure for butting the first butting surface 29 against the first receiving surface 21 as a front stop means for holding the detector 23 at the initial position. Thus, a wide butting area is secured, and the reliability of holding the detector 23 at the initial position is excellent.

The female connector Fa of the first embodiment includes the female housing 10, the lock arm 13 and the detector 23. The lock arm 13 extends rearward along the outer surface of the housing body 11 of the female housing 10. The lock arm 13 is resiliently displaceable in the directions toward and away from the outer surface of the housing body 11. The detector 23 is mounted along the outer surface of the housing body 11 and displaceable between the initial position and the detection position forward of the initial position.

The lock projection 18 is formed on the outer surface of the lock arm 13 and can be hooked to the lock receiving portion 44 of the male housing 40 when the connectors Fa, M are connected properly. The rearward facing first receiving surface 21 and the rearward facing second receiving surfaces 22 are at positions of the lock arm 13 closer to the housing body 11 than the lock projection 18. In a back view, the second receiving surfaces 22 are disposed at two positions sandwiching the first receiving surface 21 from both sides in the width direction intersecting a resilient displacing direction of the lock arm 13.

The resilient arm 26 is cantilevered forward on the detector 23 and is resiliently displaceable in the directions toward and away from the outer surface of the housing body 11. The resilient arm 26 includes the first butting portion 28, the separation restricting portion 30 and the two second butting portions 31. The first butting portion 28 butts against the first receiving surface 21 with the detector 23 at the initial position, thereby restricting a movement of the detector 23 to the detection position. The separation restricting portion 30 projects farther forward than the first butting portion 28 (first butting surface 29) from the position closer to the housing body 11 than the first butting portion 28. The separation restricting portion 30 can contact the lock arm 13 from the side of the housing body 11.

The two second butting portions 31 project from both widthwise outer side surfaces of the resilient arm 26. The second butting portions 31 butt against the two second receiving surfaces 22 with the detector 23 at the initial position, thereby restricting movement of the detector 23 to the detection position. Since a wide contact area is secured by butting the second butting portions 31 against the second receiving surfaces 22 in addition to the butting of the first butting portion 28 against the first receiving surface 21 as the front stop for holding the detector 23 at the initial position in a front stop state, a holding force as the front stop is high.

The first and second butting portions 28, 31 are side by side in the width direction. The width direction is a direction intersecting both the vertical direction (resilient displacing directions of the lock arm 13 and the resilient arm 26) and the front-rear direction (moving direction of the detector 23 between the initial position and the detection position). The second butting portions 31 are not arranged side by side with the first butting portion 28 and the separation restricting portion 30 in the vertical direction (resilient displacing direction of the lock arm 13). Thus, a vertical dimension of the resilient arm portion 26 is small, and an interval between the housing body 11 and the lock arm 13 need not be large in the vertical direction. Accordingly, the reliability of the function of holding the detector 23 at the initial position can be enhanced without enlarging the female connector Fa and the male connector M.

In the vertical direction (resilient displacing direction of the lock arm 13), the entire second butting portions 31 (at least parts of the second butting portions 31) are disposed in a region deviated downward from a formation region of the first butting portion 28. Since a range where the lock arm 13 (first and second receiving surfaces 21, 22) and the resilient arm 26 (first and second butting portions 28, 31) butt against each other is expanded in the vertical direction in this way, relative postures of the lock arm 13 and the resilient arm 26 are stabilized.

Out of the surface of the resilient arm portion 26 facing the housing body 11, the formation regions of the second butting portions 31 are in such a positional relationship as to be flush with regions (arm body 27 and separation restricting portion 30) other than the second butting portions 31. Since only the formation regions of the second butting portions 31 are not projecting on the surface of the resilient arm 26 facing the housing body 11, the entire resilient arm 26 can be brought close to the outer surface of the housing body 11 when the lock arm 13 and the resilient arm 26 are displaced resiliently. Therefore, the connector is not enlarged in the resilient displacing direction of the lock arm 13.

The lock arm 13 includes the base 14 connected to the housing body 11 and the two extending portions 15 extending rearward from the rear end of the base 14 while being spaced apart in the width direction. The two second receiving surfaces 22 are disposed between the two extending portions 15 in a back view. Accordingly, a state where the second butting portions 31 butt against the second receiving surfaces 22 can be confirmed visually through a clearance between the pair of extending portions 15 (opening region of the opening 17).

Second Embodiment

A second embodiment of a female connector Fb (connector as claimed) is described with reference to FIGS. 10 to 18. The female connector Fb of the second embodiment differs from that of the first embodiment in the configuration of a lock arm 51. Since the other components are the same as those of the first embodiment, the same components are denoted by the same reference signs and the structures, functions and effects thereof are not described.

Figure 13:
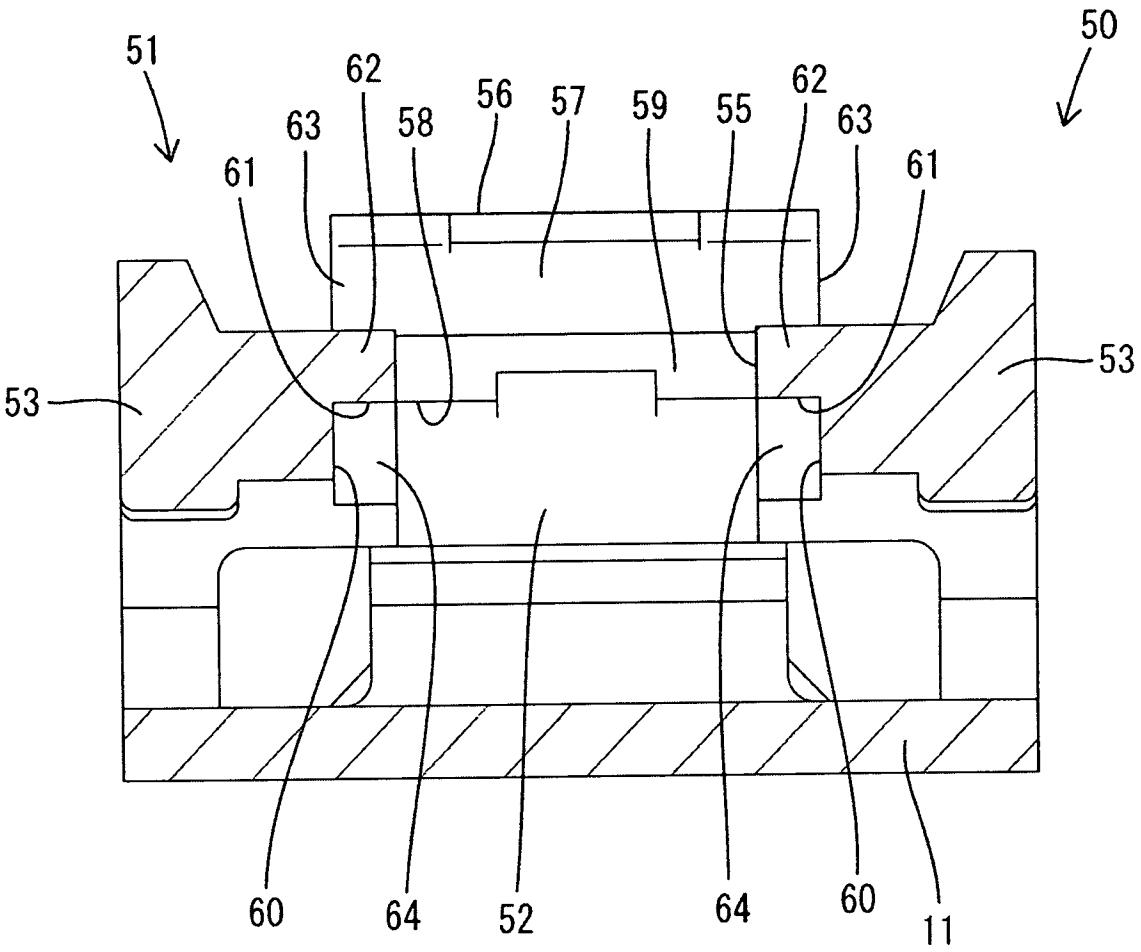
FIG. 13 is a section along Y-Y of FIG. 11.
Figure 14:
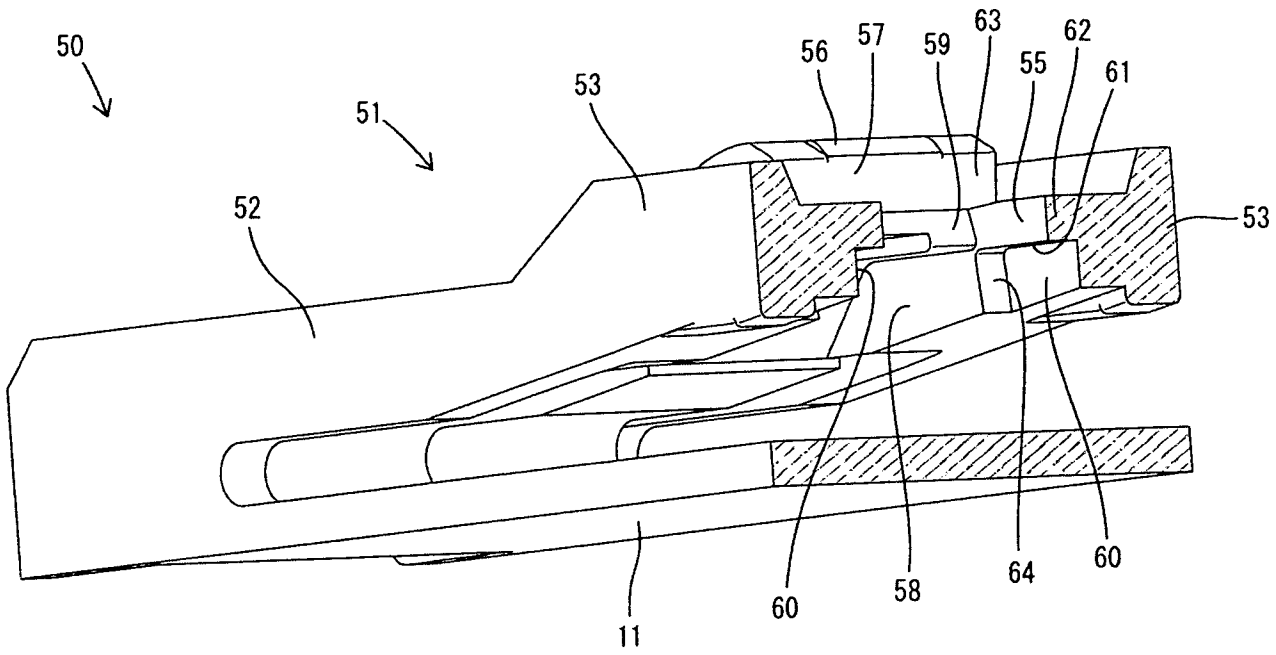
FIG. 14 is a perspective view partly in section of a lock arm.

In the second embodiment, a left side in FIGS. 10 to 12 and 14 to 18 is defined as a front side concerning a front-rear direction. Upper and lower sides shown in FIGS. 10, 11 and 13 to 18 are directly defined as upper and lower sides concerning a vertical direction. Left and right sides shown in FIG. 13 are directly defined as left and right sides concerning a lateral direction. The lateral direction and a width direction are synonymous. A resilient displacing direction of the lock arm 51, a resilient displacing direction of a resilient arm portion 66 and the vertical direction are synonymous.

Figure 10:
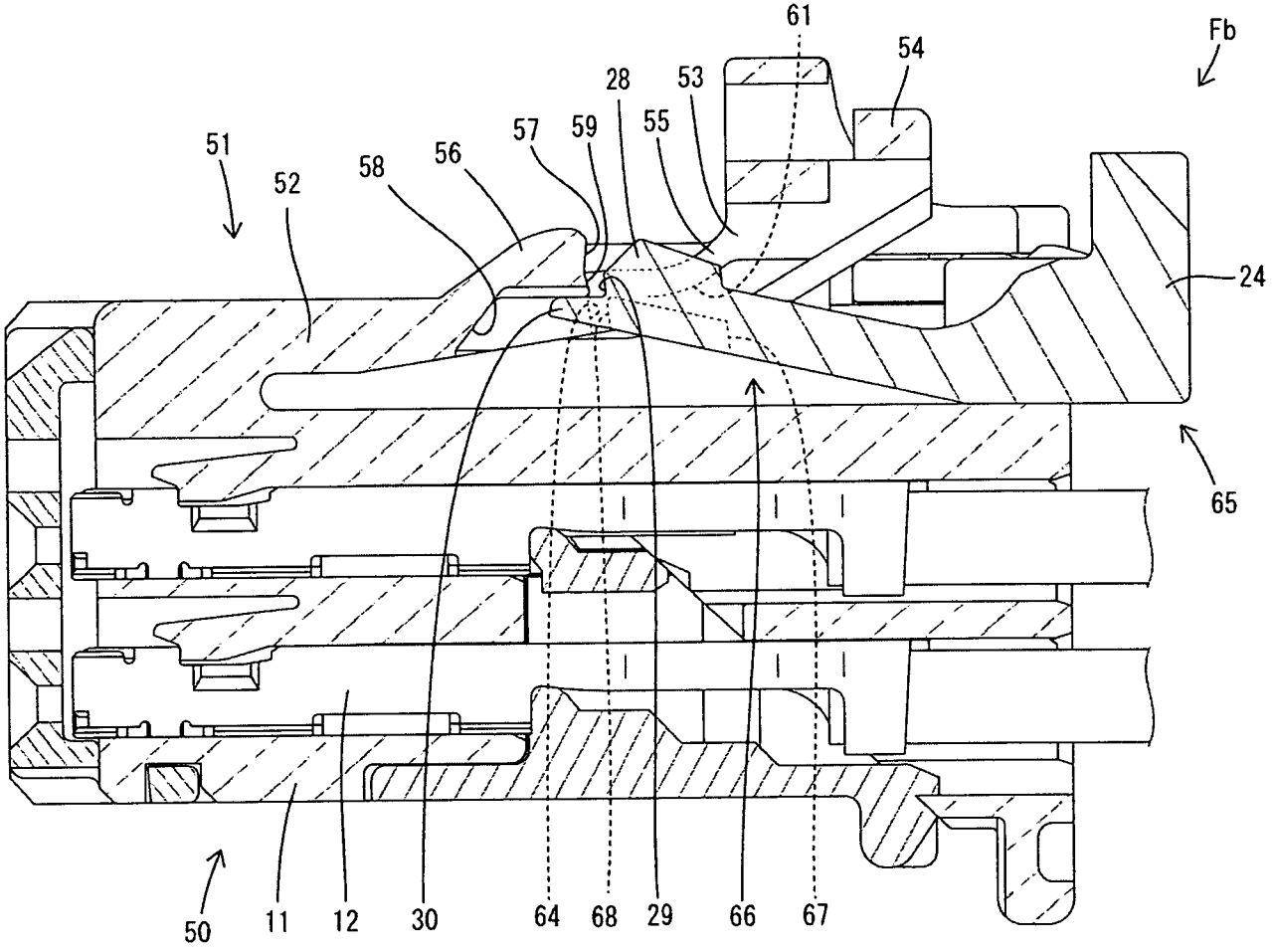
FIG. 10 is a side view in section showing a state where a detecting member is held at an initial position in a female connector (connector) of a second embodiment.

As shown in FIG. 10, the female connector Fb includes a female housing 50 (connector housing as claimed) and a detector 65. The female housing 50 includes a housing body 11 made of synthetic resin and the lock arm 51 integrally formed to the housing body 11.

Figure 11:
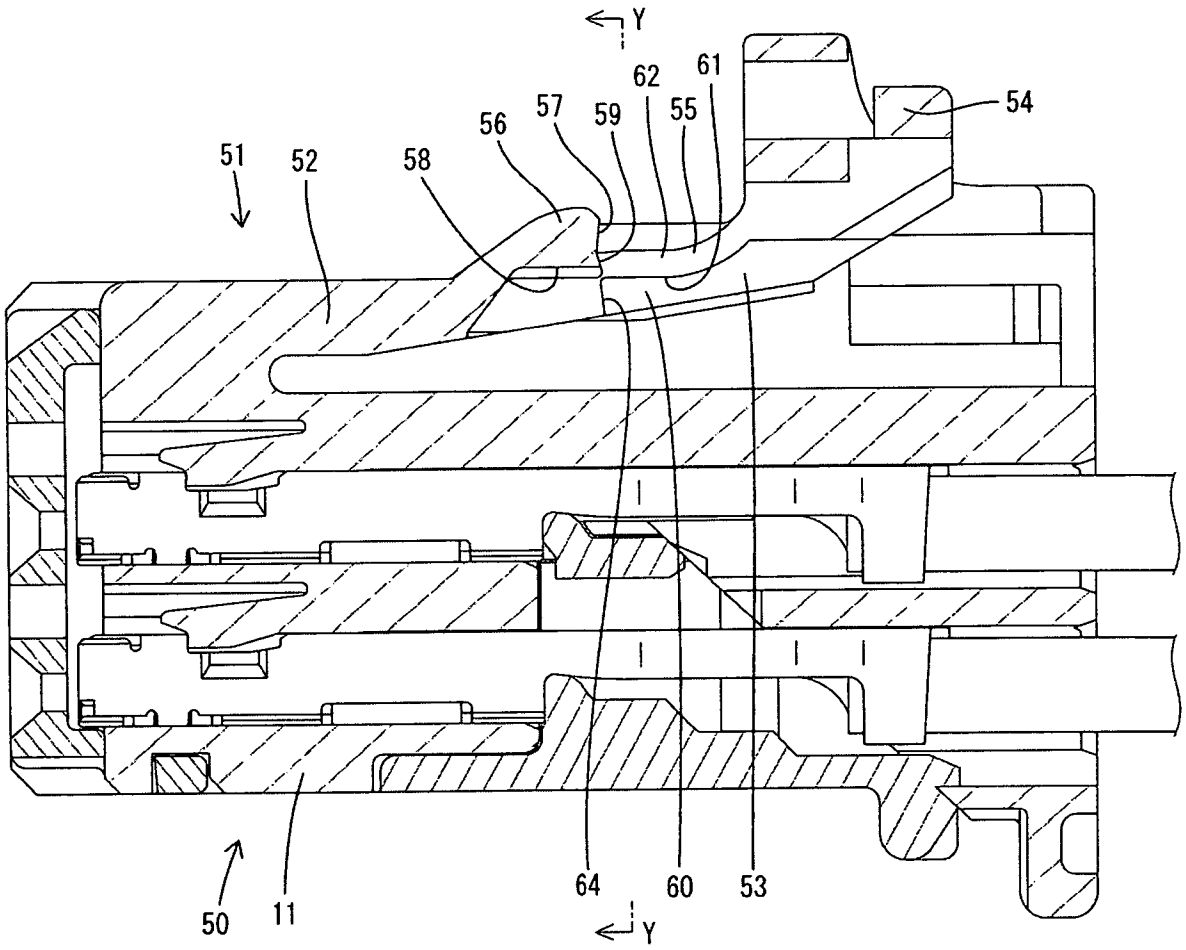
FIG. 11 is a side view in section of a female housing (connector housing).
Figure 12:
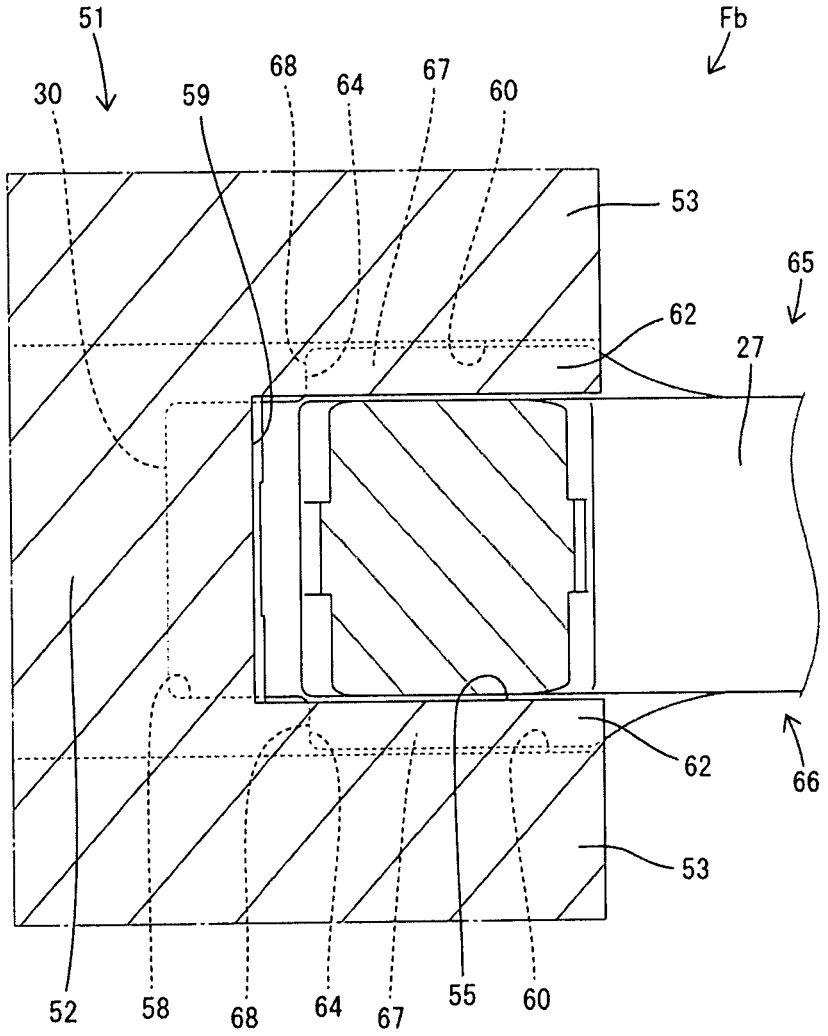
FIG. 12 is a plan view of the female housing (connector housing).

As shown in FIGS. 10 and 11, the lock arm 51 includes a base 52, left and right extending portions 53 spaced apart in the width direction, and an operating portion 54. The base 52 is a flat plate extending rearward parallel to an outer surface (upper surface) of the housing body 11 from a front part of the outer surface of the housing body 11. The two extending portions 53 extend rearward along the outer surface of the housing body 11 from both widthwise end parts of the rear end edge of the base 52. Rear end parts (extending end parts) of the two extending portions 53 are coupled by the operating portion 54.

As shown in FIGS. 11 to 14, a space of the lock arm 51 surrounded by a rear end part of the base 52, the extending portions 53 and the operating portion 54 serves as an opening 55 penetrating through the lock arm 51 in the vertical direction. A lock projection 56 projects up on a rear end part of an outer surface (surface opposite to the housing body 11) of the base 52. The rear surface of the lock projection 56 serves as a lock surface 57. A formation region of the lock projection 56 in the width direction is wider than an opening region of the opening 55. The lock arm 51 is resiliently displaceable in the vertical direction (directions toward and away from the outer surface of the housing body 11) with a front part of the base 52 as a fulcrum.

As shown in FIGS. 11 to 14, a rear part of the base 52 is formed with an accommodating portion 58 by recessing a surface of the base 52 facing the housing body 11. The accommodating portion 58 is connected below the lock projection 56. A formation region of the accommodating portion 58 in the width direction is a range inside (center side) the formation region of the lock projection 56 and the same range as the opening region of the opening 55.

A first receiving surface 59 elongated in the width direction is formed on the rear end part of the base 52. The first receiving surface 59 is located below and adjacent to the lock surface 57. The lock surface 57 and the first receiving surface 59 are disposed at the same position in the front-rear direction. A formation region of the first receiving surface 59 in the width direction is the same range as the accommodating portion 58 and a range inside the formation region of the lock projection 56. The first receiving surface 59 is disposed within the range of a formation region of the extending portions 53 (region of lower end sides of the extending portions 53) in the vertical direction. The first receiving surface 59 is facing the inside of the opening 55.

As shown in FIGS. 11 to 14, the two extending portions 53 are formed with recesses 60. The two recesses 60 are formed by recessing inner edge parts of surfaces of the extending portions 53 facing the housing body 11 in a stepped manner. Formation regions of the recesses 60 in the front-rear direction extend to a region behind the first receiving surface 59 and are open rearwardly of the extending portions 53. As shown in FIGS. 11 and 13, downward facing surfaces of the recesses 60 facing the housing body 11 serve as restricting surfaces 61.

As shown in FIG. 13, inner edge parts in the width direction of the extending portions 53 where the recesses 60 are thin portions 62 having a vertical thickness smaller than other regions. Thus, the lower surfaces of the thin portions 62 serve as the restricting surfaces 61. Ends of the lock projection 56 in the width direction serve as left and right reinforcing portions 63. The reinforcing portions 63 are disposed at the same positions as the thin portions 62, the recesses 60 and the restricting surfaces 61 in the width direction. That is, the reinforcing portions 63 are disposed in front of and adjacent to the thin portions 62. The deformation of the thin portions 62 is suppressed by the reinforcing portions 63. The reinforcing portions 63 function as the lock projection 56 and exhibit a locking function by being hooked to a lock receiving portion 44 when the female connector Fb and a male connector M are connected properly. Since the reinforcing portions 63 double as the lock projection 56, the shape of the lock arm 51 is simplified.

As shown in FIG. 13, the front surfaces of the left and right recesses 60 serve as second receiving surfaces 64 disposed to sandwich the first receiving surface 59 from both widthwise sides in a back view. As shown in FIGS. 11 and 13, formation regions of the second receiving surfaces 64 in the vertical direction are ranges below the first receiving surface 59. The upper end edges of the second receiving surfaces 64 are at the same position as the lower end edge of the first receiving surface 59 in the vertical direction. The second receiving surfaces 64 are disposed within the range of the formation regions of the extending portions 53 (regions of lower end sides of the extending portions 53) in the vertical direction. The second receiving surfaces 64 are facing the inside of the opening 55. The first receiving surface 59 and the second receiving surfaces 64 are disposed at the same position in the front-rear direction.

Figure 15:
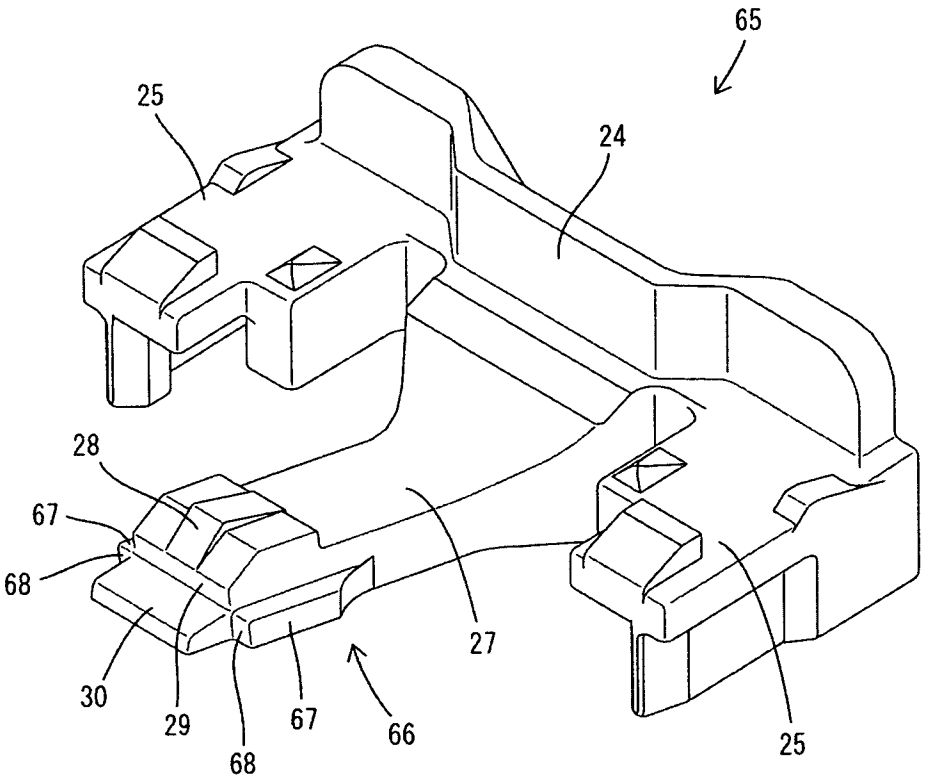
FIG. 15 is a perspective view of the detecting member of the second embodiment.

As shown in FIG. 15, the detector 65 of the second embodiment has the same basic shape as the detector 23 of the first embodiment and differs from the detector 23 of the first embodiment in side view shapes of second butting portions 67. In the first embodiment, the upper surfaces of the second butting portions 31 and the upper surface of the separation restricting portion 30 are arranged side by side in the front-rear direction to be flush with each other in a side view and the second butting portions 31 have such a trapezoidal shape that a vertical dimension gradually increases toward the rear. As shown in FIG. 10, in the detecting member 65 of the second embodiment, the upper surfaces of the second butting portions 67 are oblique to the upper surface of a separation restricting portion 30 and a vertical dimension of the second butting portion 67 is constant from a front end to a rear end in a side view.

With the detector 65 at the initial position, a front part of the resilient arm 66 is inserted in the opening 55 from the side of the housing body 11 and the first butting surface 29 of the first butting portion 28 is proximately facing the first receiving surface 59 from behind. The two second butting portions 67 are accommodated in the recesses 60 and the second butting surfaces 68 proximately face the two second receiving surfaces 64 from behind. If a forward pressing force acts on the detector 65 at the initial position, the first butting surface 29 butts against the first receiving surface 59 and the second butting surfaces 68 butt against the two second receiving surfaces 64. Since a forward (toward the detection position) movement of the detector 65 is restricted by the butting of these surfaces, the detector 65 is held at the initial position.

With the detector 65 located at the initial position, the separation restricting portion 30 is accommodated in the accommodating portion 58. The separation restricting portion 30 accommodated into the accommodating portion 58 contacts the upper surface of the accommodating portion 58 from below (side of the housing body portion 11) in a preloaded state. The pair of second butting portions 67 accommodated in the recesses 60 contact the restricting surfaces 61 (upper surfaces of the recesses 60) from below (side of the housing body 11) in a preloaded state. A relative upward (side opposite to the housing body 11) displacement of the resilient arm 66 with respect to the lock arm 51 is restricted by the contact of the separation restricting portion 30 and the second butting portions 67 in the preloaded state.

Figure 16:
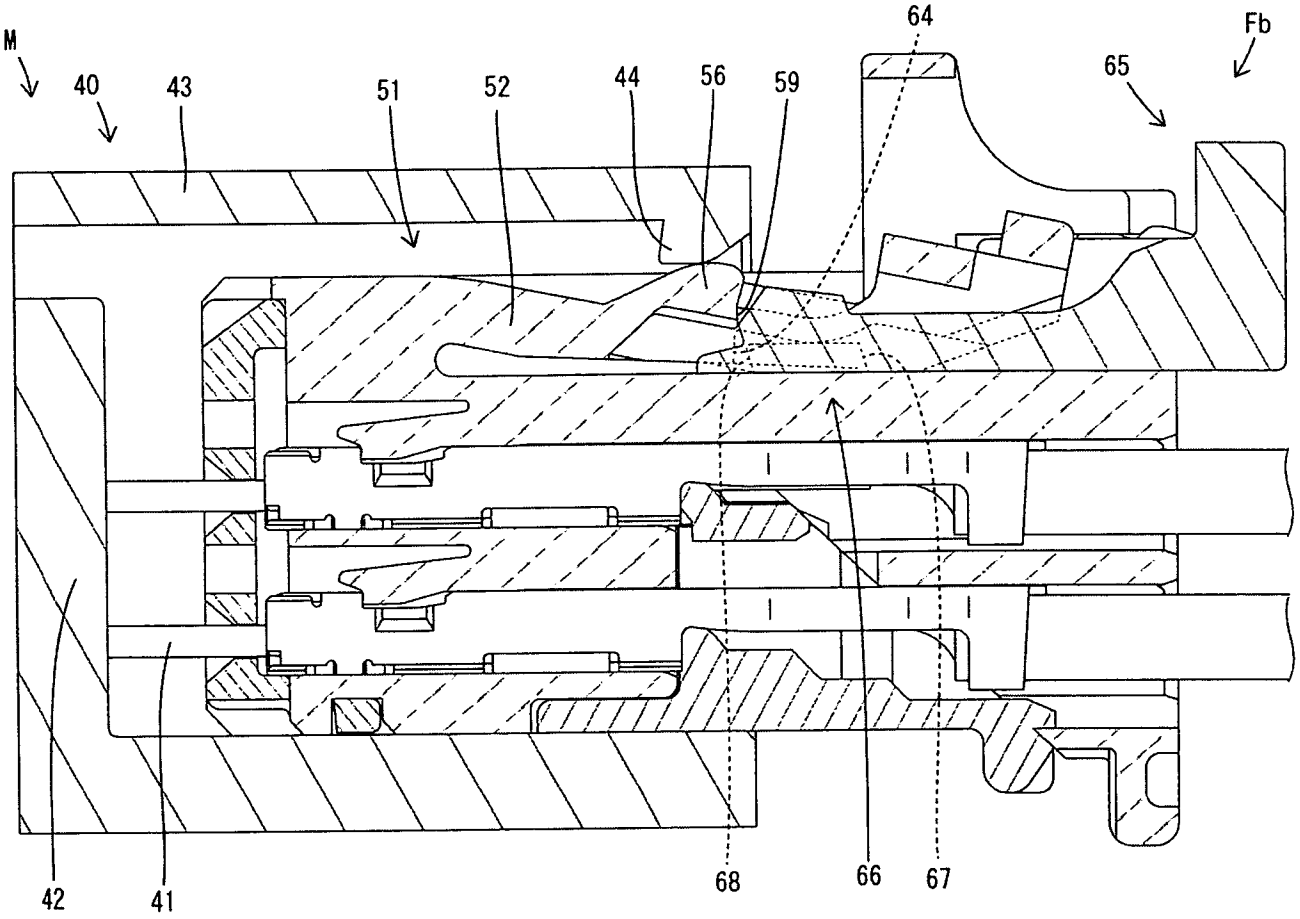
FIG. 16 is a side view in section showing a state where the female connector and a male connector are incompletely connected in a connection process.

If the connectors Fb, M are connected with the detector 65 held at the initial position, the lock projection 56 interferes with the lock receiving portion 44, as shown in FIG. 16, so that the lock arm 51 and the resilient arm 66 integrally resiliently displace toward the housing body 11 and an incompletely connected state is reached. If the detector 65 is pushed from behind in the incompletely connected state, the first butting surface 29 butts against the first receiving surface 59 and the second butting surfaces 68 butt against the second receiving surfaces 64. Thus, the detector 65 cannot be pushed to the detection position. Therefore, the detector 65 remains to be held at the initial position.

Figure 17:
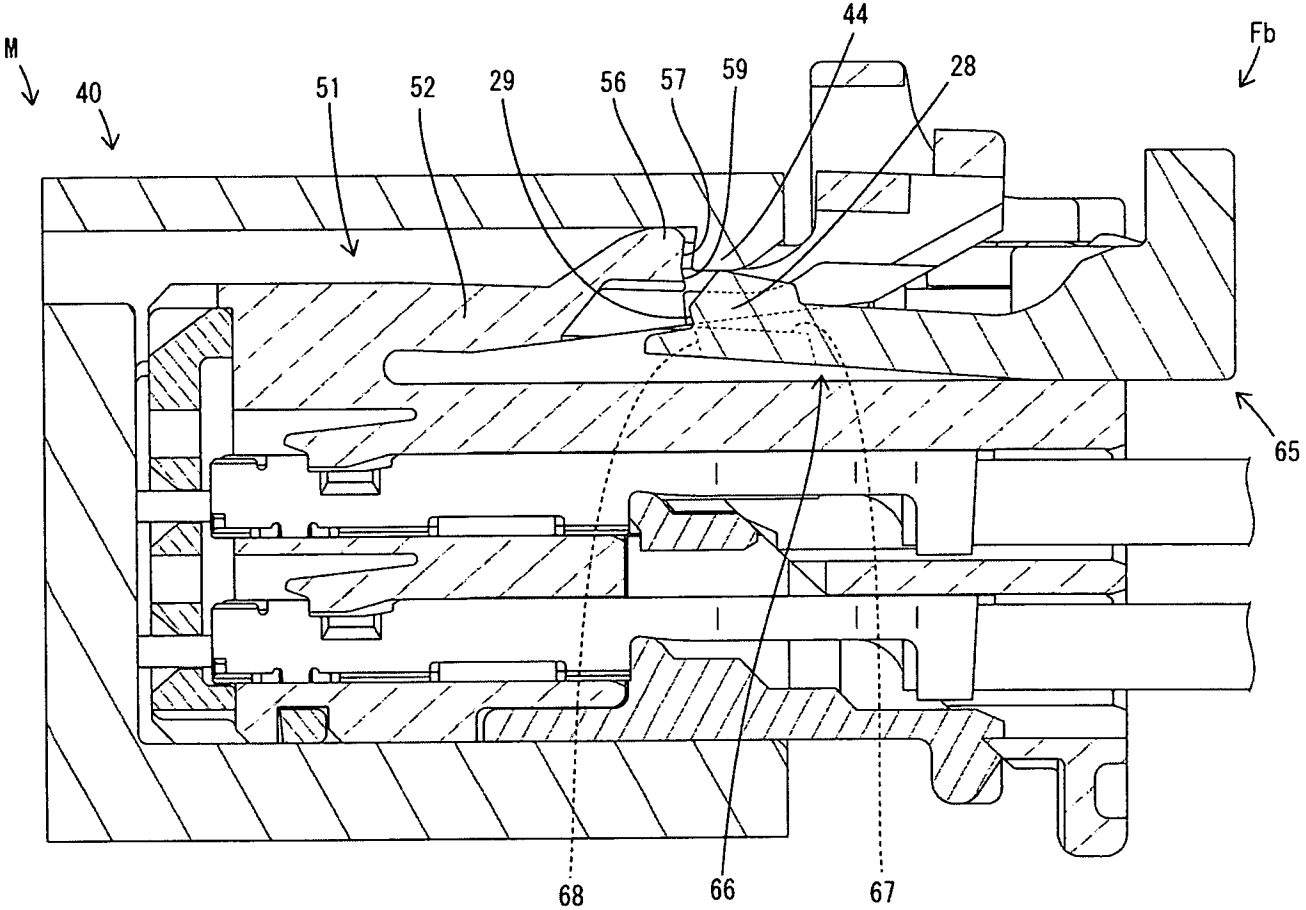
FIG. 17 is a side view in section showing a state where the female connector and the male connector are properly connected and the detecting member is at the initial position.
Figure 18:
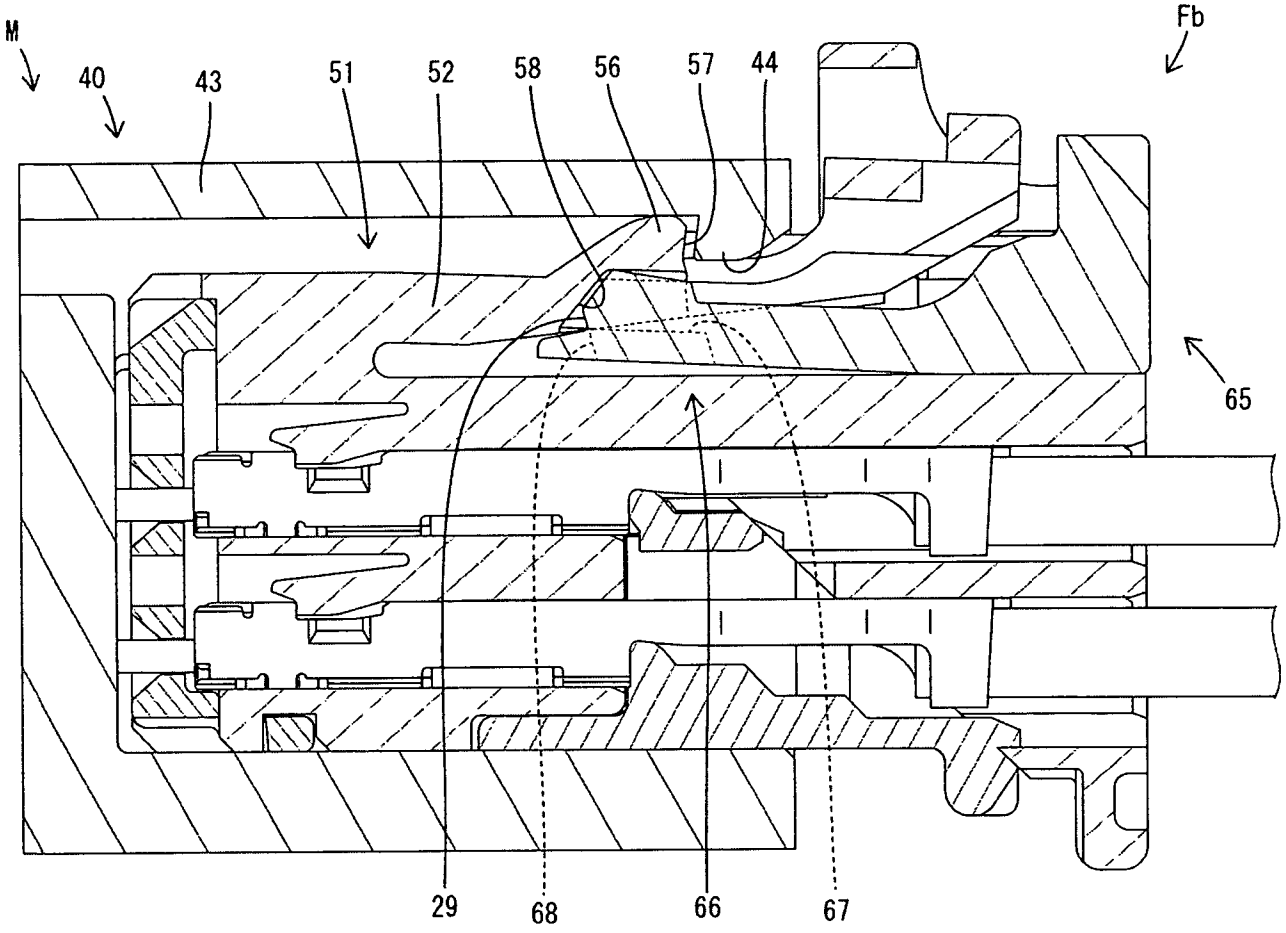
FIG. 18 is a side view in section showing a state where the female connector and the male connector are properly connected and the detecting member is at a detection position.

When the connectors Fb, M reach a properly connected state, the lock projection 56 passes through the lock receiving portion 44 and is released from a state of interference and the lock arm 51 resiliently returns to a lock position located above as shown in FIG. 17. As the lock arm 51 resiliently returns, the lock surface 57 faces the lock receiving portion 44 in the front-rear direction. Thus, the both connectors Fb, M are locked in the properly connected state where separation is restricted.

Since the first butting portion 28 interferes with the lock receiving portion 44 in the properly connected state, the resilient arm portion 66 is kept resiliently displaced toward the housing body portion 11. As the lock arm 51 resiliently returns, the first receiving surface 59 is separated upward from the first butting surface 29 and the pair of second receiving surfaces 64 are also separated upward from the pair of second butting surfaces 68. Thus, the detecting member 65 at the initial position can be moved to the detection position. Therefore, the properly connected state of the both connectors Fb, M can be detected based on whether or not the detector 65 can be moved to the detection position. With the both connectors Fb, M separated, the detector 65 can be reliably held at the initial position.

The lock arm 51 of the second embodiment includes the base 52 connected to the housing body portion 11 and the pair of extending portions 53 extending rearward from the rear end of the base 52 while being spaced apart in the width direction. The first receiving surface 59 is disposed between the extending portions 53 in a back view. The recesses 60 capable of accommodating the second butting portions 67 are formed in the surfaces of the pair of extending portions 53 facing the housing body 11. The extending portions 53 include parts (thin portions 62) for covering the second butting portions 67 from the side opposite to the housing body 11. Thus, a large width can be secured for the extending portions 53 including the recesses 60 of the second embodiment as compared to the case where there is no part for covering the second butting portions 67. Therefore, strength is high.

The two second butting portions 67 can contact the restricting surfaces 61 of the two recesses 60 from the side of the housing body 11 when the detector 65 is at the initial position. By the contact of the pair of second butting portions 67 with the pair of recesses 60 (restricting surfaces 61), an upward positional deviation of the resilient arm 66 with respect to the lock arm 51 can be restricted and the inclination of the resilient arm 66 with respect to the lock arm 51 can be restricted. In this way, a butting state of the first butting portion 28 and the first receiving surface 59 and that of the second butting portions 67 and the second receiving surfaces 64 can be reliably held.

The reinforcing portions 63 adjacent to front end parts of the inner edge parts of the extending portions 53 are formed to project on the upper surface of the base 52 on the side opposite to the housing body 11. Since the inner edge parts (thin portions 62) of the pair of extending portions 53 where the recesses 60 are formed are thinner than other parts, there is a concern about a strength reduction. However, since the reinforcing portions 63 are connected to the front parts of the inner edge parts of the pair of extending portions 53, a strength reduction of the inner edge parts of the extending portions 53 is avoided.

The invention is not limited to the above described and illustrated embodiments and is represented by claims. The scope of the invention also includes equivalent to claims and the following embodiments.

Although the entire second butting portions are disposed in regions different from the first butting portion (regions closer to the housing body than the first butting portion) in the resilient displacing directions of the lock arm and the resilient arm in the above first and second embodiments, the second butting portions may be in the same region as the first butting portion.

Formation regions of the second butting portions on the surface of the resilient arm facing the housing body are flush with the regions other than the second butting portions in the first and second embodiments. However, formation regions of the second butting portions may be recessed with respect to the regions other than the second butting portions or may project with respect to the regions other than the second butting portions.

Although the first receiving surface and the second receiving surfaces are at the same position in the front-rear direction in the first and second embodiments, the second receiving surfaces may be behind or in front of the first receiving surface.

Although the second butting portions can contact the recesses from the side of the housing body in the second embodiment, the second butting portions may not contact the recesses.

The two second butting portions can contact the two extending portions from the side of the housing body when the detecting member is at the initial position in the second embodiment. However, the second butting portions may not contact the extending portions from the side of the housing body when the detecting member is at the initial position.

The two recesses capable of accommodating the two second butting portions are formed in the surfaces of the extending portions facing the housing body in the second embodiment. However, the recesses capable of accommodating the second butting portions may not be formed in the surfaces of the extending portions facing the housing body.

Although the reinforcing portions function as the lock projection in the second embodiment, the reinforcing portions may not function as the lock projection.

Although the reinforcing portions adjacent to the front parts of the inner edges of the extending portions project on the base in the second embodiment, the base may not be formed with the reinforcing portions.

LIST OF REFERENCE SIGNS

10, 50: female housing (connector housing)
11: housing body
12: female terminal fitting
13, 51: lock arm
14, 52: base
15, 53: extending portion
16, 54: operating portion
17, 55: opening
18, 56: lock projection
19, 57: lock surface
20, 58: accommodating portion
21, 59: first receiving surface
22, 64: second receiving surface
23, 65: detector
24: rear wall
25: guided portion
26, 66: resilient arm
27: arm body
28: first butting portion
29: second butting surface
30: separation restricting portion
31, 67: second butting portion
32, 68: second butting surface
40: male housing
41: male terminal fitting
42: terminal holding portion
43: receptacle
44: lock receiving portion
60: recess
61: restricting surface
62: thin portion
63: reinforcing portion
Fa, Fb: female connector (connector)
M: male connector

What is claimed is:

1. A connector, comprising:

a connector housing;

a lock arm extending rearward along an outer surface of a housing body of the connector housing, the lock arm being resiliently displaceable in directions toward and away from the outer surface of the housing body; and a detector mounted along the outer surface of the housing body, the detector being displaceable between an initial position and a detection position forward of the initial position, wherein:

a lock projection hookable to a lock receiving portion of a mating housing is formed on an outer surface of the lock arm, a first receiving surface facing rearward and two second receiving surfaces facing rearward are formed at positions of the lock arm closer to the housing body than the lock projection, the second receiving surfaces are disposed at two positions sandwiching the first receiving surface from both sides in a width direction intersecting a resilient displacing direction of the lock arm in a back view, the detector is formed with a resilient arm cantilevered forward and displaceable in the directions toward and away from the outer surface of the housing body, the resilient arm includes a first butting portion for restricting a movement of the detector at the initial position to the detection position by butting against the first receiving surface, the resilient arm includes a separation restricting portion projecting farther forward than the first butting portion from a position closer to the housing body than the first butting portion, the separation restricting portion is capable of contacting the lock arm from the side of the housing body, the resilient arm includes two second butting portions projecting from both widthwise outer side surfaces of the resilient arm, and the second butting portions restrict the movement of the detector at the initial position to the detection position by butting against the second receiving surfaces.

2. The connector of claim 1, wherein the second butting portions are at least partially disposed in regions deviated from a formation region of the first butting portion in the resilient displacing direction of the lock arm.

3. The connector of claim 2, wherein formation regions of the second butting portions on a surface of the resilient arm facing the housing body are in such a positional relationship as to be flush with or relatively recessed with respect to regions other than the second butting portions.

4. The connector of claim 3, wherein:

the lock arm includes a base connected to the housing body and two extending portions extending rearward from a rear end of the base while being space apart in the width direction, and the second receiving surfaces are disposed between the extending portions in a back view.

5. The connector of claim 3, wherein:

the lock arm includes a base connected to the housing body and two extending portions extending rearward from a rear end of the base while being spaced apart in the width direction, the first receiving surface is disposed between the extending portions in a back view, and two recesses capable of accommodating the two second butting portions are formed in surfaces of the pair of extending portions facing the housing body.

6. The connector of claim 5, wherein the second butting portions are capable contacting the recesses from the side of the housing body when the detector is at the initial position.

7. The connector of claim 6, wherein a reinforcing portion adjacent to front end parts of inner edge parts of the pair of extending portions is formed on a surface of the base on a side opposite to the housing body.

8. The connector of claim 7, wherein the reinforcing portion functions as the lock projection.

9. The connector of claim 1, wherein formation regions of the second butting portions on a surface of the resilient arm facing the housing body are in such a positional relationship as to be flush with or relatively recessed with respect to regions other than the second butting portions.

10. The connector of claim 9, wherein:

the lock arm includes a base connected to the housing body and two extending portions extending rearward from a rear end of the base while being space apart in the width direction, and the second receiving surfaces are disposed between the extending portions in a back view.

11. The connector of claim 9, wherein:

the lock arm includes a base connected to the housing body and two extending portions extending rearward from a rear end of the base while being spaced apart in the width direction, the first receiving surface is disposed between the extending portions in a back view, and two recesses capable of accommodating the two second butting portions are formed in surfaces of the pair of extending portions facing the housing body.

* * * * *